US009622590B2

(12) United States Patent
DiMarco

(10) Patent No.: US 9,622,590 B2
(45) Date of Patent: Apr. 18, 2017

(54) MATTRESS MANUFACTURING PROCESS AND APPARATUS

(71) Applicant: DREAMWELL, LTD., Las Vegas, NV (US)

(72) Inventor: Michael A. DiMarco, Alpharetta, GA (US)

(73) Assignee: DREAMWELL, LTD., Atlanta, GA (US)

( * ) Notice: Subject to any disclaimer, the term of this patent is extended or adjusted under 35 U.S.C. 154(b) by 179 days.

(21) Appl. No.: 14/481,419

(22) Filed: Sep. 9, 2014

(65) Prior Publication Data

US 2016/0066702 A1 Mar. 10, 2016

(51) Int. Cl.

| | |
|---|---|
| ***A47C 27/15*** | (2006.01) |
| ***A47C 27/05*** | (2006.01) |
| ***A47C 27/06*** | (2006.01) |

(52) U.S. Cl.

CPC ..... *A47C 27/15* (2013.01); *A47C 27/05* (2013.01); *A47C 27/056* (2013.01); *A47C 27/064* (2013.01)

(58) Field of Classification Search

CPC ..... A47C 27/05; A47C 27/056; A47C 27/064; A47C 27/15; B29C 65/48; B29C 65/4815; B29C 65/42; B29C 65/40; B32B 41/00

USPC ..... 156/356, 357, 367, 378, 379

See application file for complete search history.

(56) References Cited

U.S. PATENT DOCUMENTS

| | | | | |
|---|---|---|---|---|
| 685,160 | A | 10/1901 | Marshall | |
| 4,234,983 | A | 11/1980 | Stumpf | |
| 4,234,984 | A | 11/1980 | Stumpf | |
| 4,439,977 | A | 4/1984 | Stumpf | |
| 4,451,946 | A | 6/1984 | Stumpf | |
| 4,523,344 | A | 6/1985 | Stumpf et al. | |
| 4,578,834 | A | 4/1986 | Stumpf | |
| 4,818,331 | A * | 4/1989 | Shimada | B29D 99/0092 156/213 |
| 5,016,305 | A | 5/1991 | Suenens et al. | |
| 5,621,935 | A | 4/1997 | St. Clair | |
| 5,792,309 | A * | 8/1998 | Eto | B68G 9/00 140/3 CA |
| 6,176,961 | B1 * | 1/2001 | Mossbeck | A47C 27/064 156/291 |
| 6,938,751 | B1 * | 9/2005 | Eubanks | B65G 47/34 198/370.1 |
| 8,679,284 | B2 * | 3/2014 | Tada | B29C 63/025 156/285 |
| 2004/0261186 | A1 * | 12/2004 | Gladney | A47C 23/00 5/717 |
| 2008/0149030 | A1 * | 6/2008 | Klein | B05C 11/1034 118/665 |
| 2008/0178996 | A1 * | 7/2008 | Tada | B29C 63/16 156/285 |
| 2009/0105866 | A1 * | 4/2009 | Fontanot | G05B 19/4183 700/112 |

* cited by examiner

*Primary Examiner* — George Koch
(74) *Attorney, Agent, or Firm* — Cantor Colburn LLP

(57) ABSTRACT

A process and apparatus for manufacturing a mattress generally includes an insertion station for applying an adhesive and inserting an innercore unit to a bucket to form an innercore unit/bucket assembly.

16 Claims, 5 Drawing Sheets

MATTRESS MANUFACTURING PROCESS AND APPARATUS

BACKGROUND

The present disclosure generally relates to mattress manufacture, and more particularly, to an automated adhesive and innercore unit insertion process for forming an innercore unit/bucket assembly.

Current processes for manufacturing the mattress include numerous steps utilizing manual labor including, among others, the process of inserting the innercore unit into a foam encased bucket assembly. For example, as shown in prior art FIG. 1, a typical process flow 10 for gluing and inserting an innercore unit to the bucket assembly generally includes two operators physically lifting the innercore unit as shown in step 12 and employing a throwing action to insert the innercore unit into a cavity defined by the bucket assembly as shown in step 14. The innercore, which is typically a rectangularly shaped layer of open or pocketed spring coils and/or foam dimensioned to fit within the cavity, is thrown because of its inherent flexibility, bulk size, and weight. These properties cause the innercore unit to collapse upon itself when lifted at about a midpoint along the length of the innercore unit. Once the innercore unit is thrown into the cavity defined by the bucket assembly, one half end of the innercore unit is lifted by both operators on opposing sides to permit one or both operators to apply an adhesive into the cavity so as to adhesively affix that particular half end of the innercore unit to the bucket assembly as shown in step 16. The operators then repeat the process for the other half end of the innercore unit so that the entirety of the innercore unit is affixed to at least the platform base layer as shown in step 18.

Not surprisingly, the above process has inherent variability as these particular steps are operator driven and manual. Application of the adhesive itself can vary across the surface since the amounts are not regulated leading to frequent instances of inadequate adhesive as well as excessive application. Inadequate glue as well as variability across the surface can lead to failures, which directly affect quality. Excessive adhesive application, translates directly to increased costs.

BRIEF SUMMARY

Disclosed herein are processes and apparatuses for manufacturing a mattress including, in particular, the process of attaching the innercore to the bucket assembly. In one embodiment, the apparatus for manufacturing a mattress component comprising an innerspring unit and bucket assembly includes an innercore unit insertion station having a support surface for supporting an innercore unit and/or a bucket; an adhesive applicator disposed about an entry point of the insertion station; a lifting system comprising a vertically adjustable platen, an adjustable frame coupled to the platen, and one or more lifting assists positioned over an interior region of the innercore unit when in use, wherein the adjustable frame and the one or more lifting assists are configured to releasably attach to the innercore unit; and a programmable control system operably linked to actuators controlling the adhesive applicator and/or the lifting system.

The process for inserting an innercore unit into a bucket during manufacture of a mattress is automated and includes feeding an innercore unit onto a support surface; mechanically lifting the innercore unit in a vertical motion from the support surface; feeding a bucket having a base layer and a side rail assembly about a perimeter of the base layer to define a cavity onto the support surface and underneath the innercore unit, wherein the innercore unit is dimensioned to fit within the cavity; applying adhesive to one or more surfaces of the cavity; and mechanically lowering the innercore unit into the cavity of the bucket to form an assembled innercore unit and bucket.

The disclosure may be understood more readily by reference to the following detailed description of the various features of the disclosure and the examples included therein.

BRIEF DESCRIPTION OF THE SEVERAL VIEWS OF THE DRAWINGS

Referring now to the figures wherein the like elements are numbered alike.

Prior Art

DETAILED DESCRIPTION

Disclosed herein is an apparatus and process for manufacturing a mattress component comprising an innerspring unit and bucket assembly that overcomes many of the above noted problems in the prior art. As will be described in greater detail below, the apparatus generally includes an automated adhesive and innercore unit insertion station and the process generally includes automating application of a controlled volume of the adhesive in a desired pattern to various surfaces within the bucket assembly followed by automated insertion of the innercore unit into the cavity defined by the bucket assembly. The apparatus and process can be integrated with a programmable logic control (PLC) and/or manufacturing execution solution (MES) systems to further minimize and/or eliminate direct operator manipulation. Advantageously, the adhesive and insertion process reduces and/or eliminates manual labor to manufacture the mattress component as well as eliminates inadequate and/or excessive adhesive being applied to the cavity surfaces during manufacture. The apparatus and process can be configured to require minimal or no manual labor to insert the innercore unit and/or apply the adhesive.

The mattress itself is not intended to be limited and may be of any type, dimension, and/or shape. For example, the mattress may be a foam mattress, a coiled mattress, a foam and coil mattress, an air mattress, combinations thereof, or the like. Typically, the mattress is square or rectangular-shaped and has a thickness ranging from about 4 inches to about 20 inches. The length and width can vary depending on the intended application and typically has a width of about 2 feet to about 7 feet and a length of about 4 feet to about 10 feet, although custom sizes may require smaller or larger dimensions.

Figure 1:
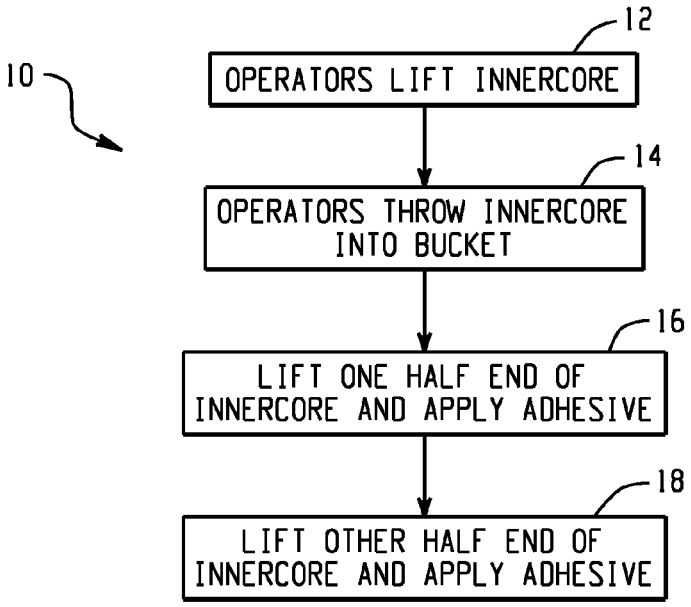
Fig. 1 PRIOR ART
FIG. 1 depicts an exemplary process flow for manufacture of the innercore and bucket assembly.
Figure 2:
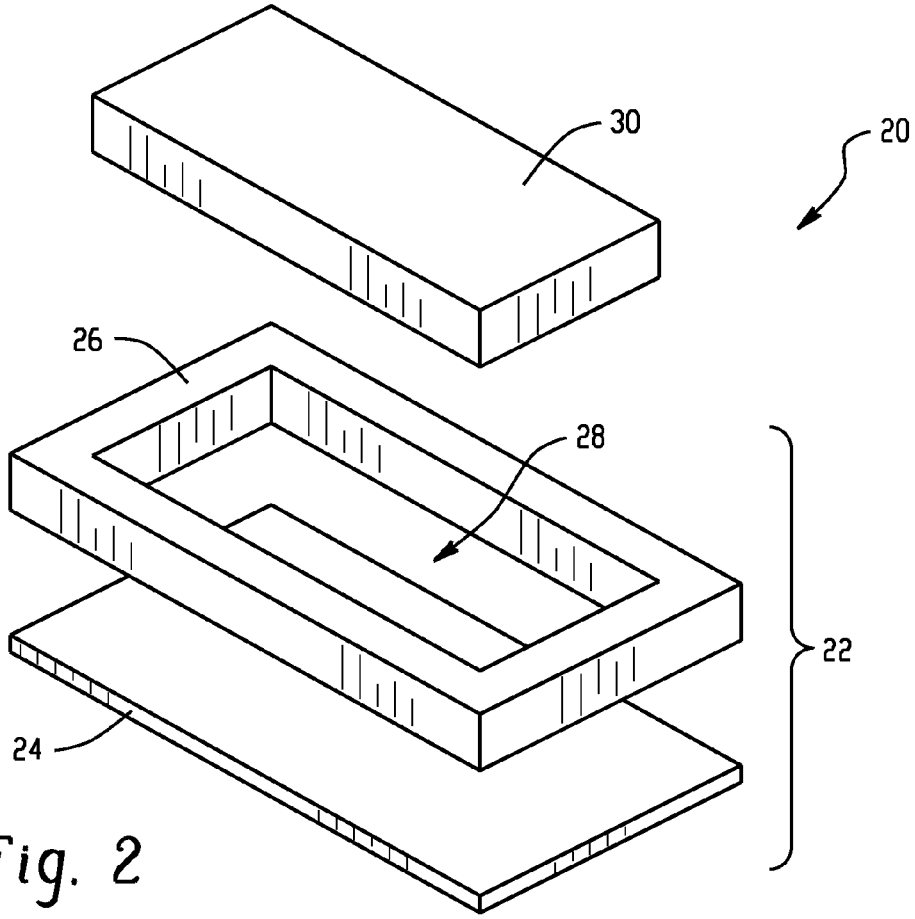
FIG. 2 illustrates an exploded perspective view of an exemplary innercore unit and bucket assembly.

FIG. 2 depicts an exemplary exploded perspective view of an innercore unit and a bucket assembly generally designated by reference numeral 20 employed in construction of the mattress. The bucket 22 generally includes a planar base layer 24 dimensioned to approximate the size of the intended mattress. The base layer 24 may consist of a foam, or it may comprise a wooden, cardboard, or plastic structure selected to provide support to the various components that define the mattress, e.g., innercore unit, side rails, and the like. Depending on the mattress innercore unit selected and its inherent stiffness, stiffer or more compliant base layers may be chosen. By way of example, the base layer 24 may be formed of a high density polyurethane foam layer (20-170 ILD), or several foam layers (20-170 ILD each), that alone or in combination, provide a density and rigidity suitable for the application. Such a choice is well within the skill of an ordinary practitioner.

A side rail assembly 26, which can be manufactured as a single piece or as multiple pieces, is affixed about the perimeter of the planar base layer 24 to define the bucket. The side rail assembly 26 is typically constructed from a dense natural and/or synthetic foam material of the type commonly used in the bedding arts. The foam may be (but is not limited to) latex, polyurethane, or other foam products commonly known and used in the bedding and seating arts and having a suitable density. A typical density is about, but not limited to 1.0 to 3.0 and more typically 1.5 to 1.9, and 20 to 60 ILD, and more typically 20 to 35. One example of such a foam is the high density polyurethane foam and is commercially available from the Foamex Corporation in Linwood, Ill. Alternatively, any foam having a relatively high indention load deflection (ILD) would be satisfactory for the manufacture of the side rail assembly. Although a specific foam composition is described, those skilled in the art will realize that foam compositions other than one having this specific density and ILD can be used. For example, foams of various types, densities, and ILDs may be desirable in order to provide a range of comfort parameters to the buyer.

The size of the side rail assembly 26 can vary according to the application, but each rail typically measures 3-10 inches (7.5-25 cm) in thickness. The depicted side rails are typically equal in width, and their length is chosen to correspond to the length of the size of mattress desired. For a regular king size or queen size mattress, the length of rails can be about 78.5 inches (200 cm), although the length can vary to accommodate the width of the header or footer, if the header or footer is to extend across the full width of the base platform 102. Similarly, the header/footer piece typically has a thickness of about 3-10 inches (7.7-25 cm), and the width is chosen to correspond to the width of the size of mattress desired. In the case of a regular king size mattress the width would be about 74.5 inches (190 cm), and for a queen size mattress, the width would be about 58.5 inches (149 cm), depending on how the foam rails are arranged to form the perimeter sidewall.

The side rail assembly 26 can be mounted or attached to base layer 24 by conventional means, such as (but not limited to) gluing, stapling, heat fusion or welding, or stitching.

The bucket 22 formed of the base layer 24 and side rail assembly 26 as constructed defines a well or cavity 28. The well or cavity 28 provides a space in which the innercore unit 30 can be inserted.

As noted above, the innercore unit 30 may be comprised of conventional helical or semi-helical coil springs and/or foam known and used in the art today. The coil springs may be open or encased in a fabric material, either individually in pockets, in groups, or in strings joined by fabric, all of which are well-known in the bedding art. For many years, one form of spring assembly construction has been known as Marshall Construction. In Marshall Construction, individual wire coils are each encapsulated in fabric pockets and attached together in strings which are arranged to form a closely packed array of coils in the general size of the mattress. Examples of such construction are disclosed in U.S. Pat. No. 685,160, U.S. Pat. No. 4,234,983, U.S. Pat. No. 4,234,984, U.S. Pat. No. 4,439,977, U.S. Pat. No. 4,451,946, U.S. Pat. No. 4,523,344, U.S. Pat. No. 4,578,834, U.S. Pat. No. 5,016,305 and U.S. Pat. No. 5,621,935, the disclosures of which are incorporated herein by reference in their entireties.

Alternatively, the innercore unit may be formed of foam or a combination of foam and coils springs. The foam, in some embodiments, can be a monolithic block of a single type of resilient foam selected from foams having a range of densities (themselves well-known in the art) for supporting one or more occupants during sleep. In one embodiment, foam core is made of any industry-standard natural and/or synthetic foams, such as (but not limited to) latex, polyurethane, or other foam products commonly known and used in the bedding and seating arts having a density of 1.5 to 1.9 and 20 to 35 ILD. Although a specific foam composition is described, those skilled in the art will realize that foam compositions other than one having this specific density and ILD can be used. For example, foams of various types, densities, and ILDs may be desirable in order to provide a range of comfort parameters to the buyer.

In an alternative embodiment, the foam core may comprise one or more horizontal layers of multiple types of foams arranged in a sandwich arrangement. This sandwich of different foams, laminated together, may be substituted for a homogeneous foam block of a single density and/or ILD.

In a further embodiment, the foam core may comprise one or more vertical regions of different foam compositions (including vertical regions having multiple horizontal layers), where the different foams are arranged to provide different amounts of support (also referred to as "firmness" in the art) in different regions of the sleeping surface.

Accordingly, the present disclosure is not limited to any particular type of foam density or ILD or even to a homogenous density/ILD throughout the foam core.

The innercore unit and bucket are then typically covered with padding layers on the top and bottom surfaces, and the whole assembly is encased within a ticking, often quilted, that is sewn closed around its periphery to a border or boxing. After assembly the mattress can be covered by any other decorative covering or pillow-top.

Figure 3:
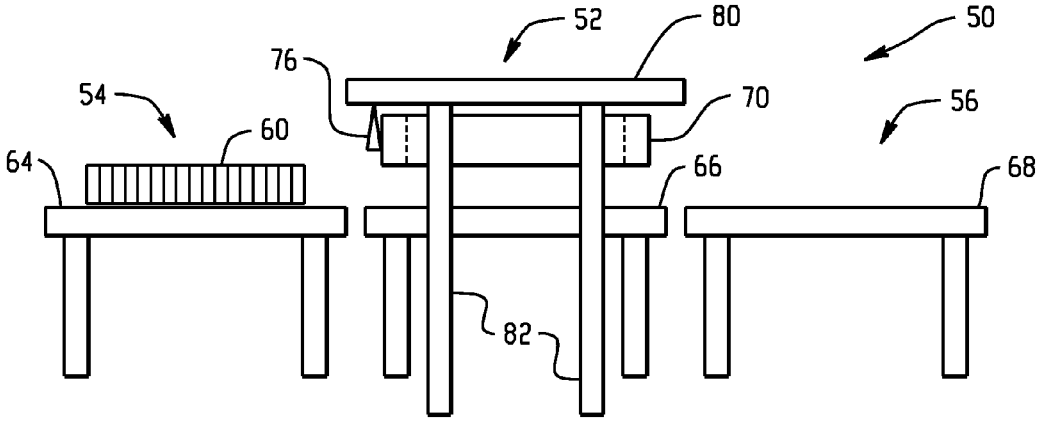
FIGS. 3-9 depicts an auto-glue and innercore unit insertion apparatus in accordance with the present disclosure at various stages for assembly of the innercore and bucket assembly in accordance with an embodiment of the present disclosure.

Referring now to FIG. 3, the apparatus 50 for the auto-glue and innercore unit insertion process for manufacturing a mattress generally includes an innercore unit insertion station 52. The apparatus 50 may further include an optional staging station 54 and an optional discharge station 56, wherein the innercore unit insertion station 52 is configured to sequentially receive an innercore unit followed by a bucket having a cavity dimensioned to receive the innercore unit (from the staging station 54 or elsewhere, e.g., may be fed directly into the innercore insertion station from another component manufacturing cell). The insertion station 52 is configured to automatically apply a controlled amount of adhesive in a desired pattern onto selected bucket surfaces and then insert the innercore unit 60 into the bucket cavity. Each of the staging, insertion and discharge stations can be serially arranged and include co-planar support surfaces 64, 66, 68, respectively, which are shown elevated but can be at ground level if desired. In one embodiment, the support surfaces 64, 66, and/or 68 can optionally include a plurality of rollers and/or a rotatable belt for feeding the innercore unit 60 into the insertion station 62 so as to minimize any forces required for feeding the innercore unit to the innercore unit insertion station. Alternatively, the plurality of rollers and/or a rotatable belt can be rotatably driven by a motor for automatically moving the innercore unit and the bucket into proper position. Adjustment to the speed of the movable support surfaces allows for tailored feed rates to pair the adhesive application with innercore unit insertion, thereby providing reproducible adhesive volume application in the desired pattern. In some embodiments, the support surfaces 64, 66, 68 may further include guide rails (shown by reference numeral 90 in FIGS. 10-11) to provide general orientation and alignment of the innercore unit 60 as it is fed and discharged from the insertion station 52. In other embodiments, the innercore and bucket units are guided through the center of each station 52, 54 and 56 by way of PLC controlled guide rails capable of aligning each component accurately to the center line of the system. The rails may utilize servo motor control to ensure alignment position and optimum force application while centering.

The apparatus 52 can be fully automated to receive size and location information of the innercore unit 60 and/or bucket 62 via a programmable logic control and/or manufacturing execution solution system (i.e., the PLC/MES system) using a radio frequency identification tag (RFID) for component identification. By way of example, RFID tags may be affixed to the innercore unit and/or bucket for wireless recognition by the PLC/MES system. In this manner, orders can be managed and scheduled from the PLC/MES system. Still further, each of the various steps for forming the innercore unit and bucket assembly can be fully automated via the programmable logic control/manufacturing execution solution system, thereby requiring no operator interaction.

In addition to the support surface 66 upon which the innercore unit 60 is inserted into the bucket 62, the insertion station 52 further includes an adhesive applicator 76 statically positioned at about an entry point and an innercore unit lifting system, which generally includes a vertically movable platen 70 supported by support 80 that is carried by one or more additional support members 82, two of which are shown.

The adhesive applicator 76 is configured to provide a controlled amount of adhesive in a desired pattern to the selected surfaces of the bucket as it is fed into the insertion station 52. The adhesive applicator 76 may be mounted directly to the insertion station structure above the entry point (i.e., an adhesive applicator bridge) such as is shown or may be a separate unit as may be desired for different applications. In this manner, the adhesive applicator can be configured to apply adhesive to the bucket as it is transferred to the support surface 66. In some embodiments, the adhesive applicators may be moveable across the bridge so that application of the glue lines within the foam cavity can be optimally located for each size and/or type of innercore unit.

In an alternative embodiment, the adhesive applicator may be dynamically operated to apply the adhesive to a statically positioned bucket once the bucket is positioned in the insertion station. For example, the adhesive applicator 76 may be carried by a horizontally movable support (not shown) that traverses the selected surfaces of the statically positioned and underlying bucket while applying adhesive therefrom.

In the foregoing embodiments, the application of the adhesive may be intermittent or continuous. Similarly, the adhesive may be applied to all of the surfaces defining the cavity of the bucket or to selected surfaces as may be desired in some applications. In one embodiment, the adhesive applicator includes a plurality of nozzles in fluid communication with a source of adhesive such as a hot melt adhesive. The adhesive applicator may optionally be coupled to a motion detector system (not shown) for actuating the nozzles as the bucket 62 is transferred into the insertion station. Alternatively, adhesive application can be triggered by product presence sensors in conjunction with PLC logic code to ensure exact start and stop of adhesive application. In one embodiment, the adhesive applicator is a dual pump spray system that provides a metered volume and the nozzles therein are configured to provide a desired pattern of an adhesive through the use of the programmable logic control device. Actuation of the adhesive applicator can be configured to occur upon detection by the motion detector system of the leading edge of the bucket assembly traveling underneath the adhesive applicator and discontinued upon detection of the trailing edge of the bucket. The automation provided by the adhesive applicator 76 provides controlled adhesive application and patterning, thereby allowing for consistent and repeatable application of the adhesive.

Figure 10:
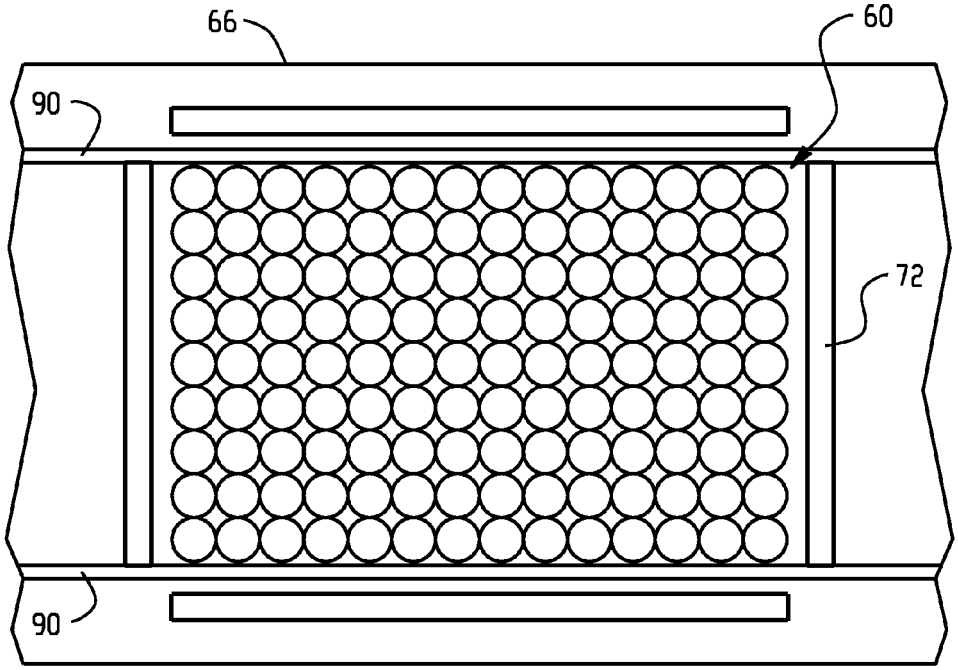
FIG. 10-12 are top down views depicting insertion of an innercore unit into a bucket with the auto-glue and innercore insertion apparatus in accordance with the present disclosure.
Figure 11:
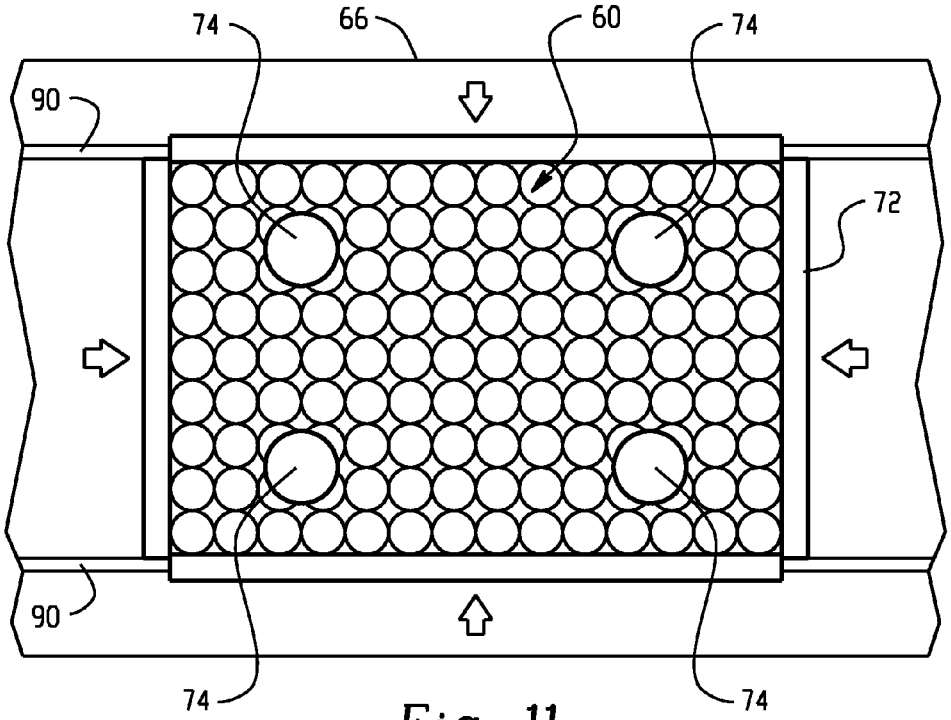

The lifting system including the vertically movable platen 70 includes an adjustable frame 72 coupled thereto (shown more clearly in the top down view provided in FIG. 10). The adjustable frame 72 is at an open position when the platen 70 is lowered such that the frame 72 can be configured to surround a perimeter of the innercore unit 60. During operation, the adjustable frame 72 then closes about the perimeter of the innercore unit as shown more clearly in FIG. 11 at an appropriate pressure effective to lift the innercore unit from the support surface when the platen is raised. The opening and closing of the adjustable frame 72 can be servo controlled to allow for precise sizing of the innercore during insertion to fully fill the cavity to specification. Referring again to FIG. 11, the platen 70 may have coupled thereto one or more lift assists 74 spaced over an interior region of the innercore unit 60 as shown so as to provide additional lifting support to the interior regions of the innercore unit 60 as it is being raised. The lifting assist 74 is not intended to be limited to any particular structure so long as the structure can releasably attach the innercore unit to the platen. An exemplary lifting assist is a pneumatic bladder gripper that is configured to releasably attach the innercore unit to the platen 70. Likewise, the number of lifting assists is not intended to be limited and may vary depending on the innercore specifications. Alternatively, a combination of lift assist device sizes may be employed for varying size openings in the different innercore type units or a combination of different devices based on the type of innercore units such as, for example, a vacuum assist.

The platen may further include stripper plates (not shown) coupled thereto that are driven by pneumatic actuators or the like to push down on the innercore unit after the innercore unit is seated in the bucket cavity so as to apply pressure to the top of the unit when the platen lifts the adjustable frame from within the bucket to effect release of the innercore unit 60. As such, consistent and uniform contact of the innercore unit to the adhesive in the bucket cavity can be made, which minimizes the amount of adhesive needed compared to the prior art and provides reproducibility with regard to adhesive strength.

Figure 4:
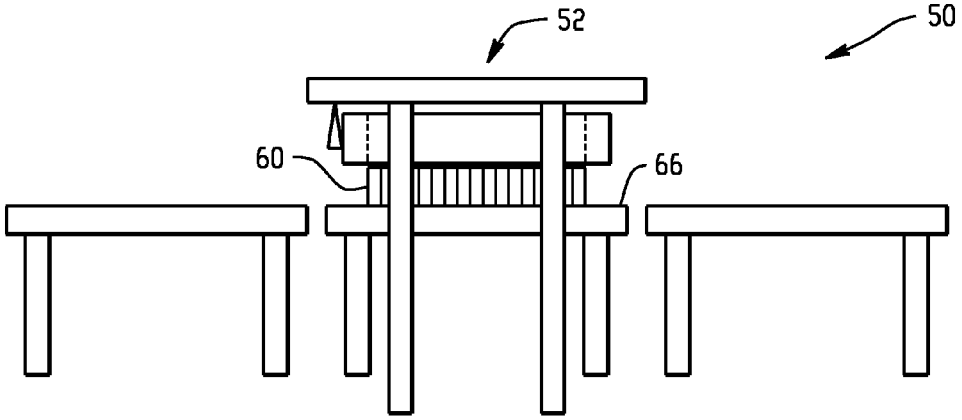

The auto-glue and insertion process is generally shown sequentially in FIGS. 3-9. In FIG. 3, the innercore unit 60 is first positioned onto the support surface 64 of the staging station 54, which is then fed onto the support surface 66 of the insertion station 52 as shown in FIG. 4.

Figure 5:
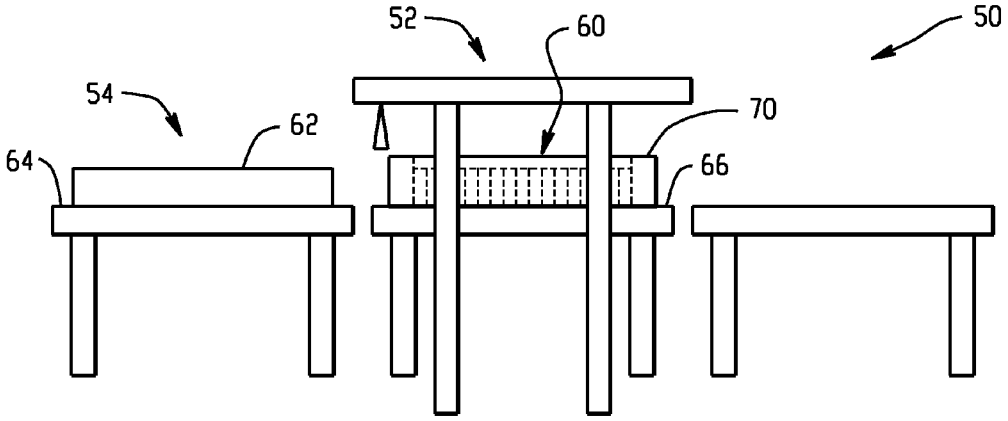

Once the innercore unit 60 is transferred to the insertion station 52 as shown in FIG. 5, a bucket 62 may then be staged on the support surface 64 of the staging station 54. Within the insertion station 52, the innercore unit 60 may be located to a base datum corner or center line by the system and maintained in that position. The insertion station 52 then lowers the lifting system including the platen 70, which comprises an adjustable frame 72 in the open position (shown more clearly in the top down view provided in FIG. 10). The adjustable frame 72 surrounds a perimeter of the innercore unit 60 as the platen 70 is lowered. The adjustable frame 72 then closes about the perimeter of the innercore unit (as shown more clearly in FIG. 11) at an appropriate pressure effective to lift the innercore unit from the support surface 66 of the innercore station.

Figure 6:
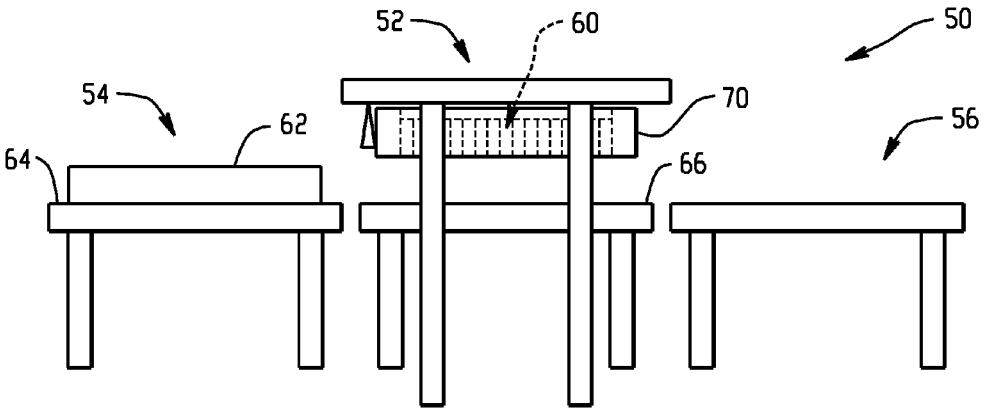

In FIG. 6, the innercore unit 60 is lifted from the support surface 66 of the insertion station 52. The innercore unit 60 is lifted at a distance effective to provide sufficient clearance for transferring the bucket 62 from support surface 61 of the staging station 54 onto the support surface 66 of the insertion station 52.

Figure 7:
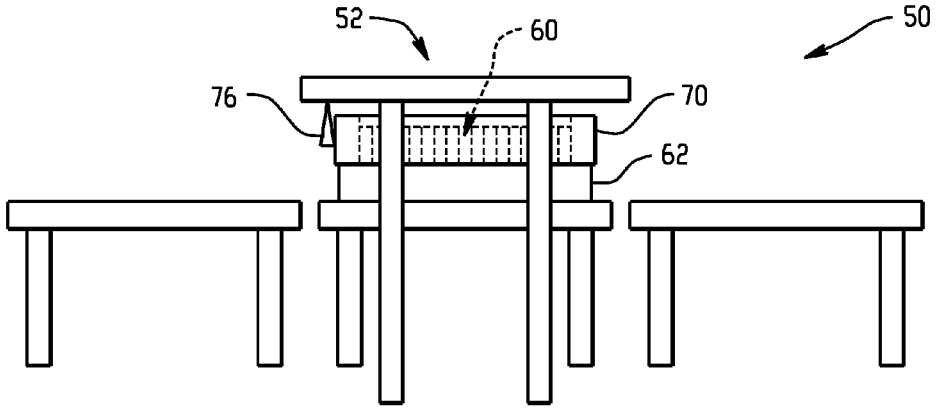

In FIG. 7, the bucket 62 is shown transferred from the staging station 54 into the insertion station 52. An adhesive such as a hot melt adhesive is applied from the adhesive applicator 76 to an interior surface of the bucket as it is moved into position or as it is constrained depending on whether the adhesive applicator is configured as statically positioned or dynamically moved. The PLC/MES system may be programmed to adjust the adhesive application based on innercore type, size, and coil diameters, when indicated, to ensure maximum adhesion with minimal adhesive volume. The bucket 62 may be constrained in the same locating system to a base datum corner or center line as was employed for the innercore unit.

Figure 8:
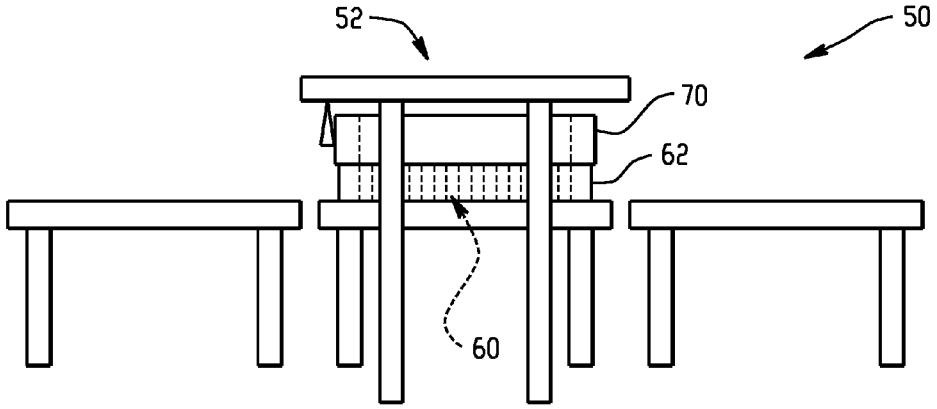
Figure 9:
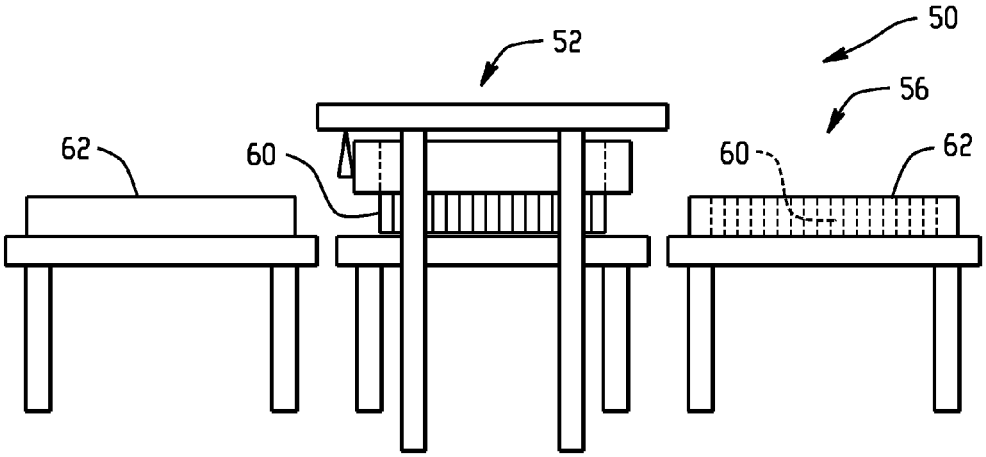
Figure 12:
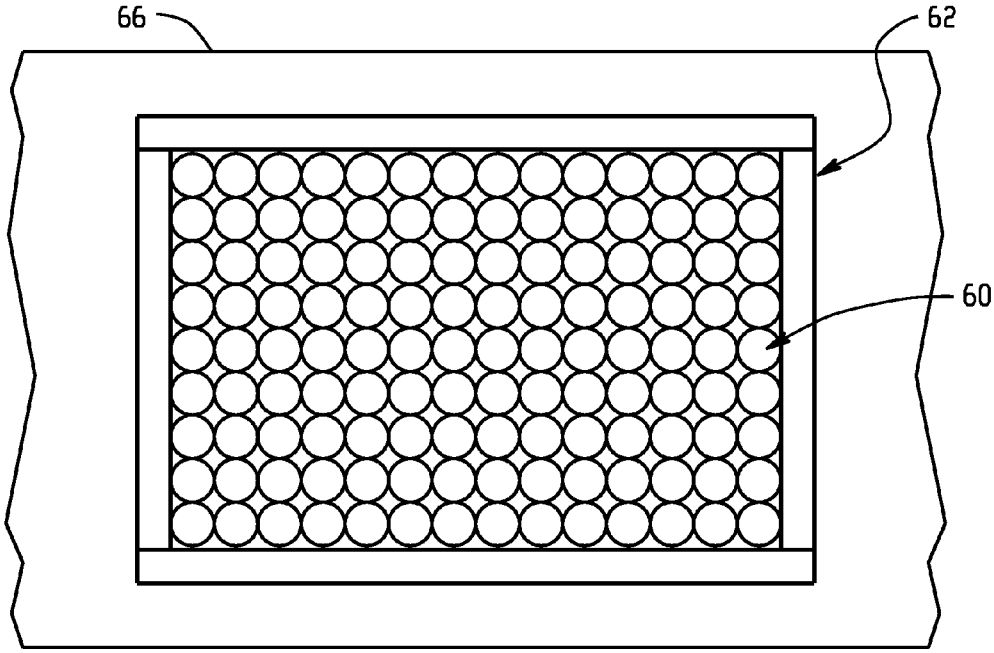

In FIG. 8, the platen is lowered and the innercore unit 60 is inserted precisely within the cavity defined by the bucket 62 adjusting pressure to allow for an accurate fit within the bucket with no manual operation or operator interaction. As shown, the innercore unit insertion station 52 locates and lifts the innercore unit 60 in the same area of the innercore insertion station that it locates and holds an underlying bucket 62, thereby minimizing the footprint of the apparatus. The lift assists 74 and frame 72 (see FIG. 11) then release the innercore unit 60. Stripper plates (not shown) on the platen driven by pneumatic actuators or the like to push down on the innercore unit applying pressure to the top of the innercore unit when the platen lifts the frame 72 from within the bucket 62. When the platen 70 is fully clear, the assembled innercore unit and bucket 80 is transferred to the discharge station 56 as shown in FIG. 9. A top down view of the assembled innercore unit and bucket 80 is shown clearly in FIG. 12. As shown, the process may be repeated, wherein an additional innercore unit is staged and transferred to the insertion station followed by an additional bucket that is staged and further processed in the manner described above.

The auto-glue and insertion process significantly reduces cycle time compared the prior art. Moreover, operator interaction is minimal since system may be fully automated by use of the PLC and/or MES system, which may be linked to a computer control panel. The PLC and/or MES system may be operably linked to the various actuators utilized to insert the innercore unit into the bucket cavity. Data arrays or tables can be employed for each innercore and bucket type to be assembled, and the appropriate table selected prior to commencement of manufacture of any particular innercore and bucket type. In order to facilitate the creation and modification of the tables, they can be created using a computer spreadsheet, which is well within the skill of those in the art. Use of RFID for component identification enhances changeovers and allows for simple correction for variation between different innercore and bucket types.

Designing the appropriate algorithms to perform the various steps in the process is well within the skill of those in the art. Moreover, the process is repeatable and provides controlled amounts of adhesive in selected patterns that can be tailored to the particular innercore unit and bucket being assembled.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An apparatus for manufacturing a mattress component comprising an innercore unit and bucket assembly, the apparatus comprising:

an innercore unit insertion station comprising:

support surface for supporting an innercore unit and/or a bucket;

an adhesive applicator disposed about an entry point of the insertion station and oriented to spray adhesive onto selected surfaces of the bucket;

a lifting system comprising a vertically adjustable platen, an adjustable frame coupled to the platen and configured to open and close about a perimeter of the innercore unit, and one or more lifting assists positioned over an interior region of the innercore unit when in use, wherein the adjustable frame and the one or more lifting assists are configured to releasably attach to the innercore unit; and a programmable control system operably linked to actuators controlling the adhesive applicator and/or the lifting system.

2. The apparatus of claim 1, wherein the adhesive applicator comprises a plurality of nozzles in fluid communication with an adhesive.

3. The apparatus of claim 1, wherein the adhesive applicator further comprises a motion detector for detecting a leading and trailing edge of the bucket assembly and triggering activation and deactivation of the adhesive applicator.

4. The apparatus of claim 1, wherein the adhesive applicator comprises a plurality of nozzles in fluid communication with a hot melt adhesive.

5. The apparatus of claim 1, wherein the innercore unit and bucket are wirelessly identified by the programmable logic control system by radiofrequency identification tags attached thereto.

6. The apparatus of claim 1, wherein the innercore unit comprises coil springs, foam or a combination thereof, and the bucket comprises foam.

7. The apparatus of claim 1, wherein the one or more lifting assists comprise pneumatic bladder grippers.

8. The apparatus of claim 1, wherein the support surface comprises a motor driven conveyor.

9. The apparatus of claim 1, further comprising a staging station and/or a discharge station, wherein the staging and/or discharge stations comprise a support surface for supporting the innercore unit and bucket.

10. The apparatus of claim 1, wherein the support surfaces of the staging station, insertion station and/or a discharge station comprise guide rails.

11. The apparatus of claim 10, wherein the guide rails are operably linked to a servo motor control configured to provide positioning, pressure control, and speed of the innercore unit and/or bucket on the support surface.

12. The apparatus of claim 1, wherein the adhesive applicator comprises a hot melt adhesive in fluid communication with a plurality of nozzles, wherein the plurality of nozzles are oriented to spray the hot melt adhesive onto selected surfaces of the bucket.

13. The apparatus of claim 1, wherein the adhesive applicator is statically positioned at the entry point and is in operative communication with a motion detector, wherein the adhesive applicator and is configured to apply adhesive to selected surfaces of the bucket upon detection by the motion detector of a leading edge of the bucket and to discontinue application of the adhesive upon detection of the trailing edge of the bucket.

14. The apparatus of claim 1, wherein the adjustable frame is configured to open and surround a perimeter of the innercore when the platen is lowered and to close about the perimeter at a pressure effective to lift the innercore unit from the support surface when the platen is raised.

15. The apparatus of claim 1, further comprising one or more plates coupled to the lifting system and driven by an actuator to push down on the innercore unit after the innercore unit is seated in the bucket cavity.

16. The apparatus of claim 1, wherein the programmable control system is further operably linked to actuators that control an indexing conveyor system and component alignment guides of the support surface for positioning the innercore unit and/or bucket during operation of the apparatus.

* * * * *